US007616770B2

(12) United States Patent
Haba

(10) Patent No.: US 7,616,770 B2
(45) Date of Patent: Nov. 10, 2009

(54) ELECTRO-ACOUSTIC APPARATUS

(75) Inventor: Daisuke Haba, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 740 days.

(21) Appl. No.: 10/664,485

(22) Filed: Sep. 17, 2003

(65) Prior Publication Data

US 2004/0109573 A1 Jun. 10, 2004

(30) Foreign Application Priority Data

Sep. 19, 2002 (JP) ..... 2002-272521

(51) Int. Cl.
*H04R 1/02* (2006.01)

(52) U.S. Cl. ..... 381/87; 381/119; 381/390; 248/680; 248/681; 248/177.1; 248/223.41; 248/224.51; 248/224.61; 248/500; 248/506

(58) Field of Classification Search ..... 381/119, 381/124, 76, 87, 361, 366, 363, 374, 390; 248/500, 166, 158, 688, 676, 469, 467, 518, 248/519, 80, 97, 105, 181, 127–128, 177.1, 248/680–681, 506, 223.41, 224.51, 224.61
See application file for complete search history.

(56) References Cited

U.S. PATENT DOCUMENTS 4,479,240 A * 10/1984 McKinley, Jr. ..... 381/80
4,545,276 A 10/1985 Curletto
4,634,090 A 1/1987 Currie et al.
5,060,638 A * 10/1991 Bodine, Jr. ..... 602/21
5,395,178 A * 3/1995 Chvojcsek ..... 403/349
5,538,212 A * 7/1996 Kennedy ..... 248/215
5,738,328 A * 4/1998 O'Farrill ..... 248/500
5,762,168 A * 6/1998 Miyoshi ..... 190/18 A
6,412,737 B1 * 7/2002 Minagawa ..... 248/166
6,439,515 B1 * 8/2002 Powers ..... 248/129
6,801,630 B1 * 10/2004 Shibata ..... 381/119

(Continued)

FOREIGN PATENT DOCUMENTS

JP 61-255577 11/1986

(Continued)

*Primary Examiner*—Vivian Chin
*Assistant Examiner*—Disler Paul
(74) *Attorney, Agent, or Firm*—Morrison & Foerster LLP

(57) ABSTRACT

A bottom base 15*a* of a transportable mixer M is provided with internal threads 16*a*, while the upper end of a stand 20 is provided with external threads 25*a* which engage the internal threads 16*a*. The mixer M is adapted to be mounted on the stand 20 by the threaded engagement between the internal threads 16*a* and external threads 25*a*. Furthermore, a groove 15 is provided on an under surface 14 of the mixer M, the groove 15 extending from one end of the under surface 14 to the other end through the center. On the groove 15 there are provided the internal threads 16*a*. The mixer M is formed to have a low front part and a high rear part, such that a top surface 11 of the mixer M has a low front part and a high rear part when placed on a table 26, and stays on a substantially horizontal position when mounted on the stand 20. As a result, a transportable electro-acoustic apparatus capable of being fixed on and supported by a stand is provided.

5 Claims, 8 Drawing Sheets

U.S. PATENT DOCUMENTS

| | | | | |
|---|---|---|---|---|
| 7,119,267 | B2 * | 10/2006 | Hirade et al. | 84/602 |
| 2002/0009205 | A1 * | 1/2002 | Mercs et al. | 381/119 |
| 2003/0066410 | A1 * | 4/2003 | Stratton | 84/422.1 |

FOREIGN PATENT DOCUMENTS

| | | |
|---|---|---|
| JP | 3-90480 | 9/1991 |
| JP | 3009699 | 2/1995 |
| JP | 2002-151858 | 5/2002 |

* cited by examiner

ELECTRO-ACOUSTIC APPARATUS

BACKGROUND OF THE INVENTION

1. Field of the Invention

The present invention relates to an electro-acoustic apparatus comprising a mixer, recorder, or the like which can be fixed on and supported by a stand.

2. Description of the Related Art

Conventional electro-acoustic apparatuses such as audio mixers and recorders are placed on a base such as a table when they are used (e.g. see Japanese Registered Utility Model No. 3009699).

When an electro-acoustic apparatus is reduced in size and weight in order to make it transportable, a supporting member such as a base which supports the electro-acoustic apparatus is also required to be transportable. However, the conventional base such as a table on which the electro-acoustic apparatus is placed is hardly transportable.

SUMMARY OF THE INVENTION

The present invention was accomplished to solve the above-described problem, and an object thereof is to provide a transportable electro-acoustic apparatus which can be fixed on and supported by a stand.

In order to achieve the above-described object, a structural feature of the electro-acoustic apparatus according to the present invention lies in the electro-acoustic apparatus being small enough to be transportable, wherein a multiplicity of operators are provided on a top surface of a body, internal threads are provided on a under surface of a body, and said internal threads are adapted to be engaged with external threads provided at the upper end of a stand, thereby allowing said electro-acoustic apparatus to be fixed on the upper end of the stand and supported by the stand.

Another structural feature of the electro-acoustic apparatus according to the present invention lies in the electro-acoustic apparatus having a multiplicity of terminals, connecting with a plurality of electronic apparatuses through cords removably connected to the terminals, and controlling the electronic apparatuses, the electro-acoustic apparatus being small enough to be transportable, wherein a multiplicity of operators controlling the external electronic apparatuses connected through the cords are provided on a top surface of a body, internal threads are provided on a under surface , and the internal threads are adapted to be engaged with external threads provided at the upper end of a stand, thereby allowing the electro-acoustic apparatus to be fixed on the upper end of the stand and supported by the stand.

The electro-acoustic apparatus of the present invention structured as the above is adapted to be transportable and capable of being supported by the stand. As a result, the electro-acoustic apparatus as well as the stand can be carried to any desired place for use. Moreover, the electro-acoustic apparatus is provided with the internal threads on the under surface of the body, while the upper end of the stand is provided with the external threads adapted to engage the internal threads provided on the under surface. By the threaded engagement between the internal threads and the external threads, the electro-acoustic apparatus is adapted to be mounted on the upper end of the stand. Therefore, the electro-acoustic apparatus can be easily mounted and demounted on/from the stand.

For mounting the electro-acoustic apparatus, stands such as those for mounting a microphone or camera can be used. In addition, the electro-acoustic apparatus mounted on the stand can be directed toward various directions; the top surface may face forward or upward by changing the orientation of the electro-acoustic apparatus.

Another structural feature of the electro-acoustic apparatus according to the present invention lies in that a groove is provided on the reverse surface of the opposed surface of the body, the groove extending from one end of the reverse surface to the other end through the center of the reverse surface, and the internal threads are provided on the groove. Since the groove is provided on the reverse surface of the opposed surface of the body, the user can easily hold the electro-acoustic apparatus by placing his/her hand on the groove, and thereby easily carry about the electro-acoustic apparatus. Due to the groove, furthermore, the electro-acoustic apparatus increases in strength.

Still another structural feature of the electro-acoustic apparatus according to the present invention lies in that the electro-acoustic apparatus is formed to have a low front part and a high rear part, such that the top surface of the electro-acoustic apparatus has a low front part and a high rear part when placed on a table, and stays on a substantially horizontal position when mounted on the stand.

Because of the feature, for example, when the electro-acoustic apparatus is placed on a table and operated by a user sitting on a chair, the top surface of the electro-acoustic apparatus has a low front part and high rear part, providing the user with easy operability. When the electro-acoustic apparatus is mounted on a stand, on the other hand, the top surface of the electro-acoustic apparatus is kept on a horizontal line, and the user is allowed to operate the electro-acoustic apparatus in a comfortable position, looking down on the electro-acoustic apparatus from above in a standing position. Applicable as the stand are upright stands, which allow the electro-acoustic apparatus to maintain stability.

In this case, since the groove is formed on the under surface of the body from the front end of the under surface to the rear end such that the bottom base (the ceiling) of the groove is formed in substantially parallel with the top surface of the body, the top surface of the electro-acoustic apparatus can be kept on a substantially horizontal line when mounted on the stand. The internal threads are preferably provided at substantially the center of the groove or the position in the groove slightly moved off backward from the center of gravity of the electro-acoustic apparatus. When the bottom base of the groove is not in parallel with the top surface of the body, furthermore, the top surface of the electro-acoustic apparatus mounted on the stand can be kept substantially horizontal by forming the internal threads obliquely.

DESCRIPTION OF THE PREFERRED EMBODIMENT

Figure 1:
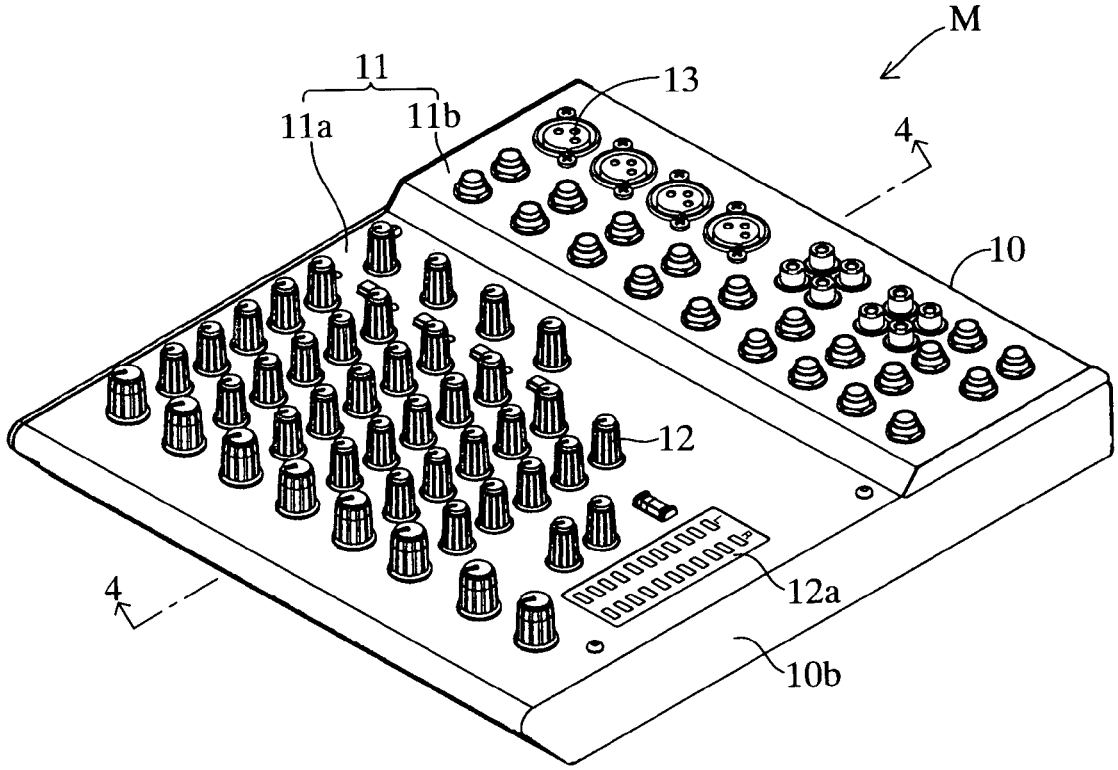
FIG. 1 is a perspective view showing the top surface of a mixer comprising an embodiment of an electro-acoustic apparatus according to the present invention.
Figure 2:
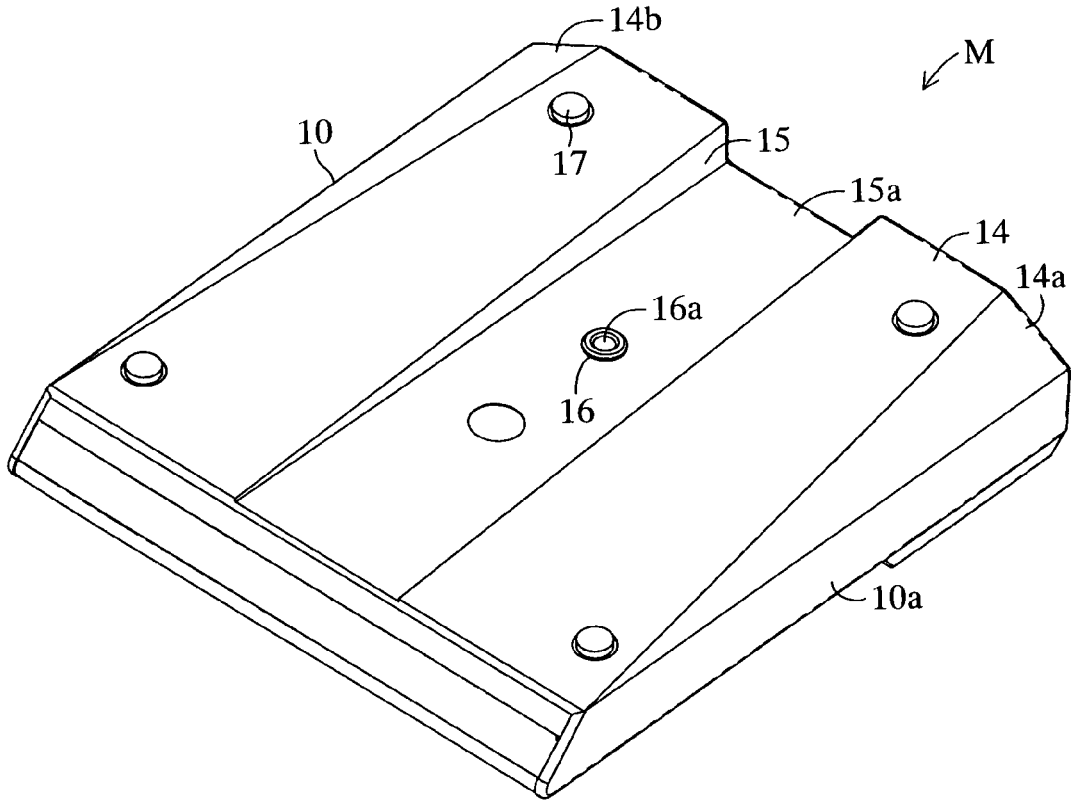
FIG. 2 is a perspective view showing the under surface of the mixer shown in FIG. 1.
Figure 3:
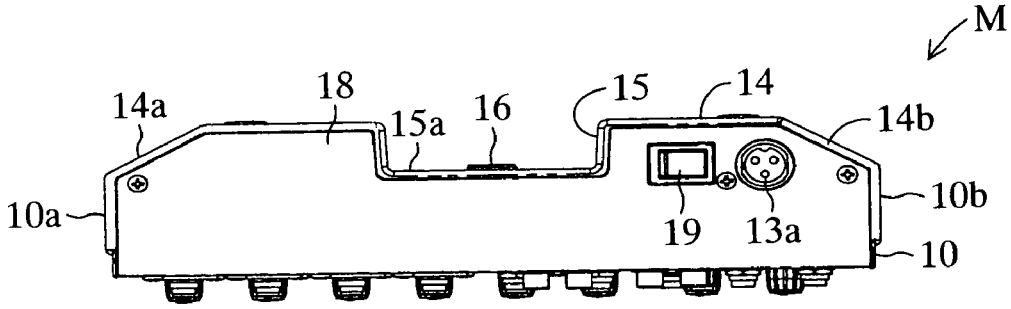
FIG. 3 is a rear view of the mixer shown in FIG. 1.
Figure 4:
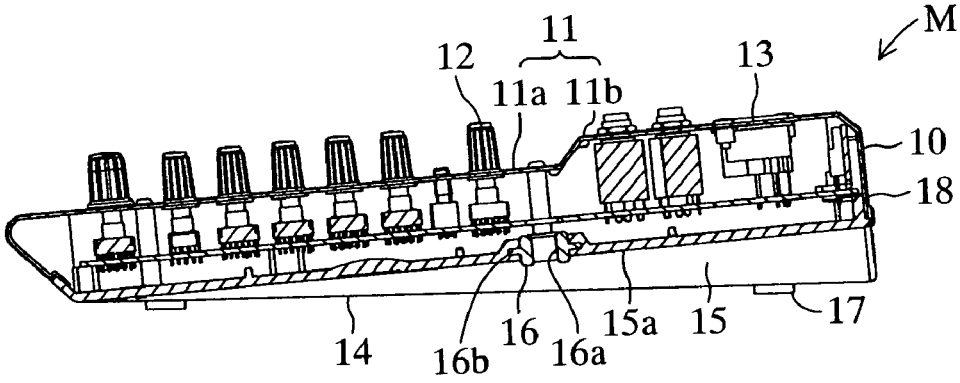
FIG. 4 is a cross sectional view of the mixer shown in FIG. 1, taken along section lines 4-4.

An embodiment of the present invention will now be described with reference to the drawings. FIGS. 1 through 4 show an audio mixer M which is an electro-acoustic apparatus according to the present invention. FIG. 1 is a perspective view seen obliquely from above. FIG. 2 is a perspective view seen obliquely from below. FIG. 3 is a rear view. FIG. 4 is a cross sectional view of FIG. 1 taken along section lines 4-4.

A body 10 forming an outer part of the mixer M, which is formed by resin material, is a quadrangle on a plane. The body 10 is shaped like a box and designed to have a low front part (lower-left side of FIG. 1) and a high rear part (upper-right side of FIG. 1). On a top surface 11 of the body 10 there is provided a step which lowers the front part and hightens the rear part. The front part forms an operator mounting part 11*a*, and the rear part forms a terminal mounting part 11*b*. On the operator mounting part 11*a* there are mounted a plurality of operators 12 at given intervals. On the terminal mounting part 11*b* there are mounted a variety of connector terminals 13 at given intervals. A level meter 12*a* is provided on the front part of a top surface 11. A level meter 12*a* is comprised of a plurality of right emitting devices for right channel and a plurality of left emitting devices for left channel.

On an under surface (a bottom surface) 14 of the body 10, as shown in FIG. 2, there is formed a groove 15 extending from the front end to the rear end through the center in a lateral direction. The width of the groove 15 is designed to fit an adult's arm. A bottom base 15*a* (equivalent to a ceiling part of the groove 15 in FIG. 1) is formed in parallel with a top surface 11 of the body 10. The resulting groove 15 has shallow depths at its front part and deep depths at its rear part. At the position slightly moved off backward from the center of the bottom base 15*a* (the position slightly moved backward from the center of gravity), there is provided a mounting part 16 substantially shaped like a ring. At the inner surrounding surface of the mounting part 16 there is formed a screw hole having internal threads 16*a* of the present invention.

Figure 5:
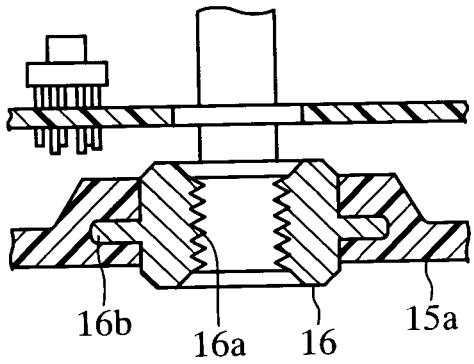
FIG. 5 is a magnified section view of a mounting part.

The mounting part 16 is formed from metal. As shown in FIGS. 4 and 5, in the middle of the outer surrounding surface of the mounting part 16 there is formed a flange-like projection 16*b*. The mounting part 16 is fitted on the bottom base 15*a* of the groove 15 with its outer surrounding surface fixed to the bottom base 15*a* by outsert molding. Moreover, the projection 16*b* stops the mounting part 16 from dropping out of the bottom base 15*a*. The bottom tip of the mounting part 16 slightly projects downward out of the bottom base 15*a* of the groove 15.

At the vicinity of the four corners of the under surface 14 of the body 10 there are provided discoid supportive protrusions 17, projecting out of the under surface 14. Between the under surface 14 of the body 10 and side faces 10*a* and 10*b* there are provided triangular slanting surfaces 14*a* and 14*b* respectively whose width is increased in their rear part. Also formed on the rear of the body 10 is a rear panel 18 on which a switch 19 and connector terminal 13*a* are provided.

Figure 6:
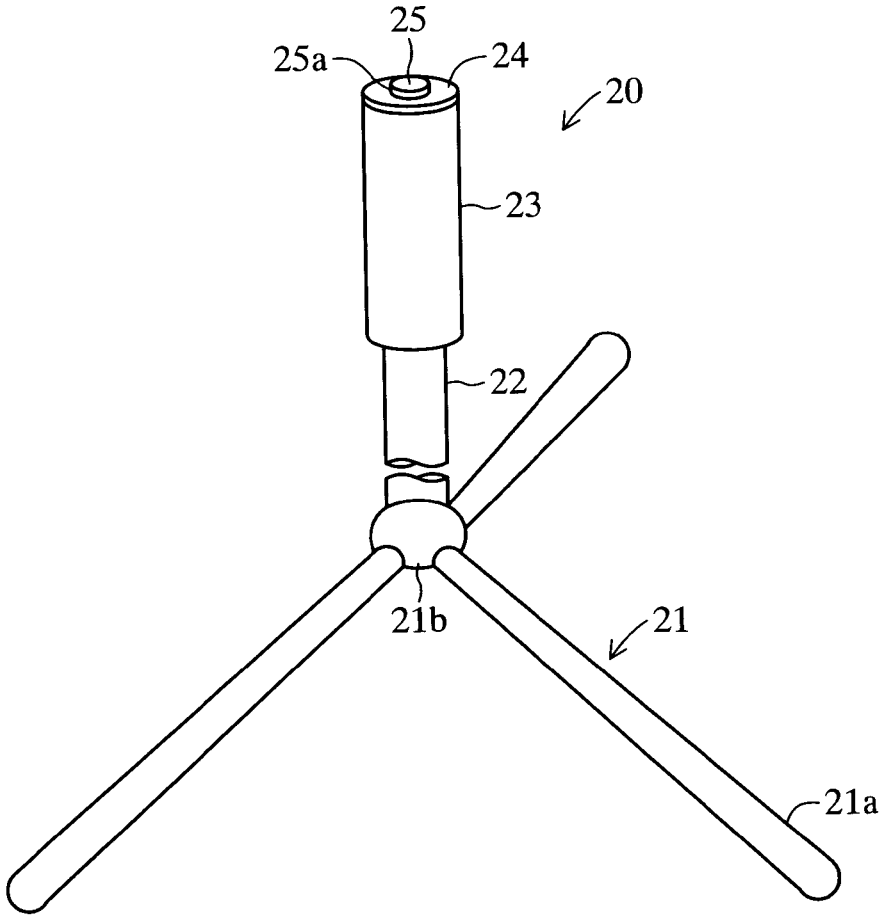
FIG. 6 is a perspective view of a stand.
Figure 7:
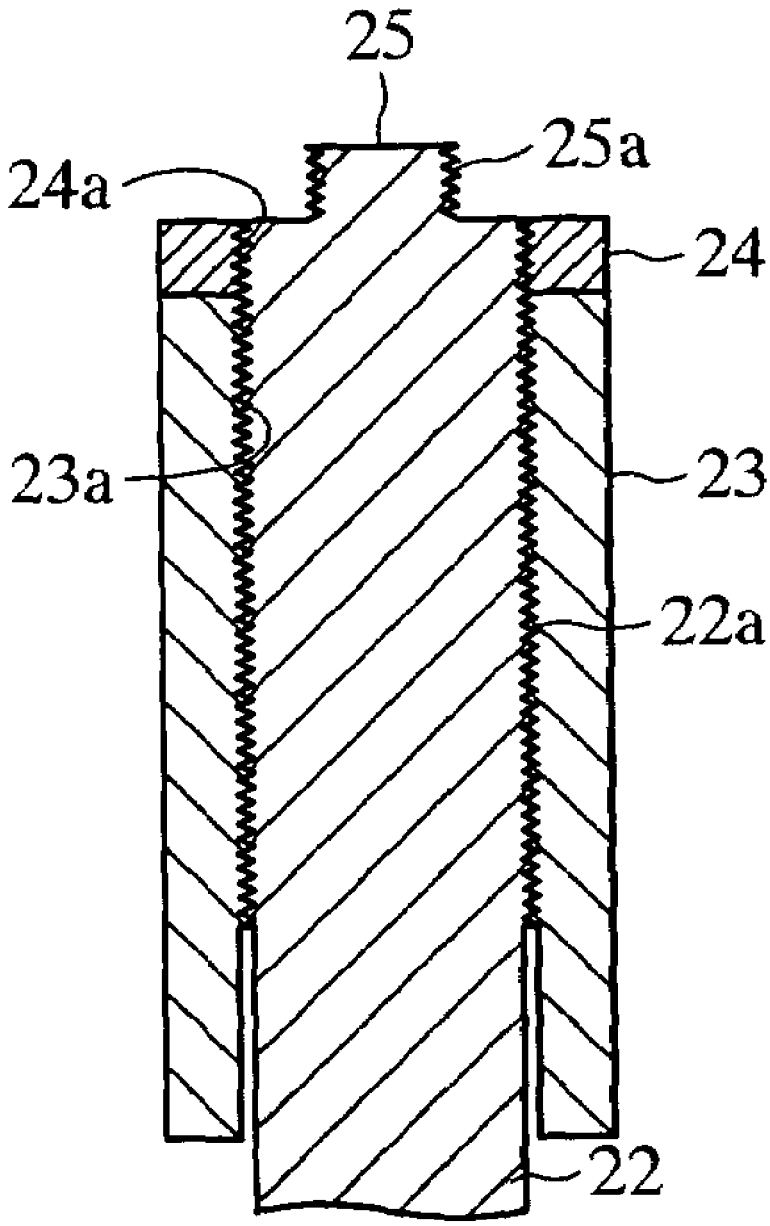
FIG. 7 is a cross sectional view showing distinctive part of the stand.

FIG. 6 shows a stand 20 for supporting the mixer M. The stand 20 is composed of a tripod 21 comprising three legs 21*a* and a connecting part 21*b* connecting the three legs 21*a*, a stand pole 22 extending upward from the tripod 21, a pipe-like rotating member 23 provided around the outer circumference of the upper end of the stand pole 22, and a clamp ring 24 provided on the upper end of the rotating member 23. The bottom tip of the stand pole 22 are provided with external threads, while the connecting part 21*b* of the tripod 21 are provided with internal threads, so that the engagement between the external threads and internal threads connects the stand pole 22 with the tripod 21. Also formed at the outer surrounding surface of the upper part of the stand pole 22, as shown in FIG. 7, are external threads 22*a*.

Out of the upper end surface of the stand pole 22 a jointing part 25 projects upward. At the outer surrounding surface of the jointing part 25 there are provided external threads 25*a* which engage internal threads 16*a* provided on the mounting part 16 of the mixer M. By screwing the internal threads 16*a* of the mounting part 16 and the external threads 25*a* of the jointing part 25 together, the mixer M is mounted on the upper end of the stand 20.

Formed on the inner surrounding surface of the rotating member 23 and clamp ring 24 are internal threads 23*a* and 24*a*, respectively which are engaged with the external threads 22*a* of the stand pole 22. The threaded engagement between the external threads 22*a* and the internal threads 23*a* and 24*a*, which is provided by rotating upward the rotating member 23 and clamp ring 24 about the stand pole 22, ensures the securing of the mixer M to the stand 20 when the internal threads 16*a* of the mounting part 16 are engaged with the external threads 25*a* of the jointing part 25.

Figure 8:
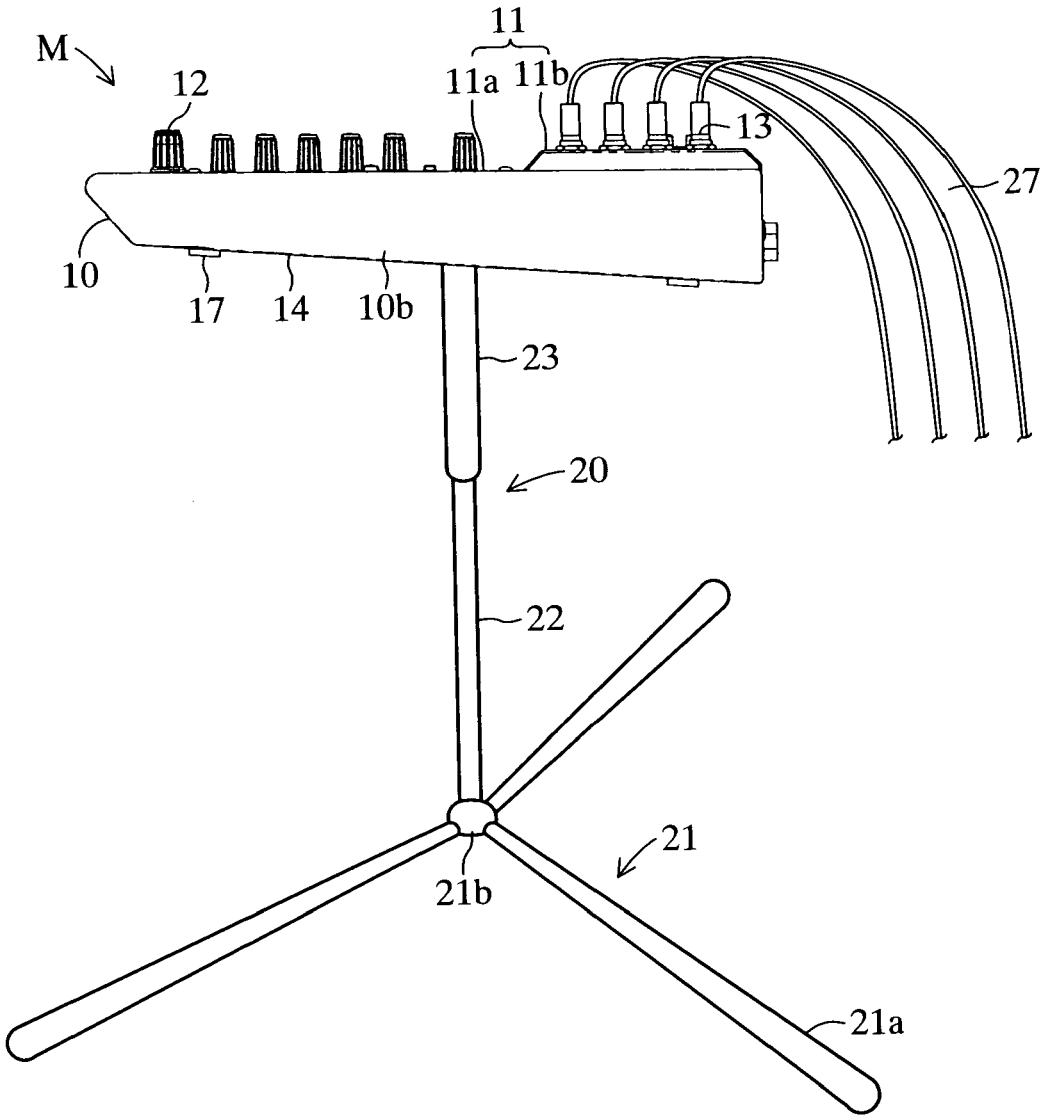
FIG. 8 is a side view showing a state in which the mixer is fixed on the stand.
Figure 9:
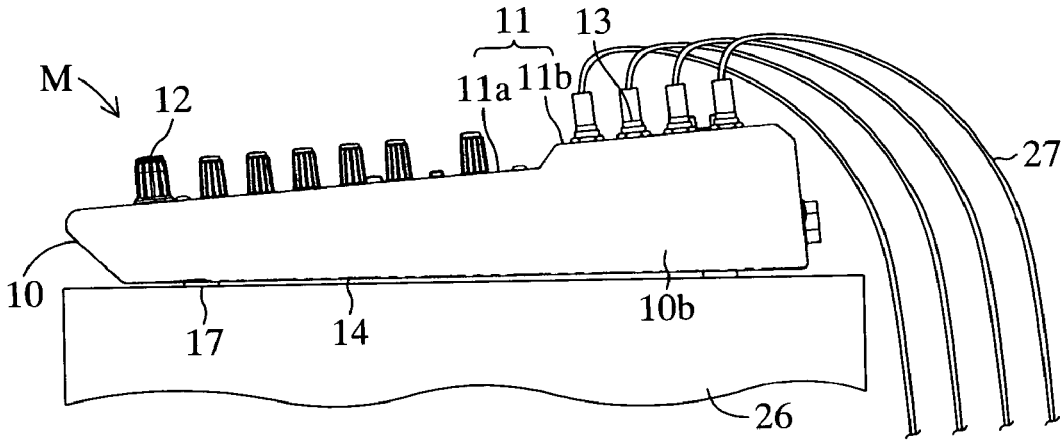
FIG. 9 is a side view showing a state in which the mixer is placed on a table.

The mixer M configured as described above, which is connected with input devices and output devices through the connector terminals 13, is operated by user's operation on the operators 12. When operated, the mixer M is placed on the stand 20 as shown in FIG. 8, although it can be used on a table 26 as shown in FIG. 9. In order to set up the mixer M on the stand 20, the tripod 21 is connected to the stand pole 22 in order to erect the stand 20 on floor. Subsequently, the external threads 25*a* provided at the upper end of the stand 20 are mated with the internal threads 16*a* of the mixer M, and the mixer M is rotated.

The procedure causes threaded engagement between the external threads 25*a* and internal threads 16*a*, resulting in the mixer M fastened on the stand 20. Next, the clamp ring 24 is rotated in order to move upward until it is contacted with the bottom tip surface of the mounting part 16. At this procedure, because the mounting part 16 projects out downward from the bottom base 15*a*, a user is allowed to have enough room in screwing the clamp ring 24, without having difficulty that would be caused by the user's fingers touching the bottom base 15*a* when screwing the clamp ring 24. The user then rotates and moves the rotating member 23 upward, holding the midsection of the rotating member 23 until the clamp ring 24 is further pressed against the mounting part 16. By these procedures, the mixer M is fixed on the stand 20 more securely.

Connected to the connector terminals 13 and 13*a* are various cords 27 originating from electronic apparatuses such as a microphone, musical instrument, and recorder. Through the cords 27, the mixer M is connected with a plurality of electronic apparatuses.

When the mixer M is set up on the stand 20, the top surface 11 of the mixer M is kept on a horizontal line. As a result, the user can operate the mixer M in a standing position, looking down on the top surface 11 of the mixer M. To the connector terminals 13 provided on the terminal mounting part 11*b* of the mixer M the plurality of cords 27 are connected which extend toward the rear of the mixer M, resulting in the weight of the cords 27 being exerted on the rear part of the mixer M. However, the mounting part 16 of the mixer M having the internal threads 16*a* which are engaged with the external threads 25*a* of the stand 20 is formed at the position slightly moved off backward from the center of the bottom base 15*a* of the groove 15 of the body 10, resulting in the stand 20 standing erect in balance with the mixer M mounted thereon.

More specifically, since the stand 20 supports the mixer M at the position slightly moved off backward from the center of the bottom base 15*a*, and the bottom base 15*a* is located above the under surface 14 of the body 10, the mixer M has its center of the gravity at the lower part thereof, maintaining improved stability. By the user's operations on the operators 12, the mixer M retrieves audio signals from various musical apparatuses such as electronic musical instrument, electric musical instrument and microphone for converting tones emitted from various musical instruments, human voices, etc. into electric signals in order to control loudness and change tones. The mixer M then transmits the signals to output apparatuses.

Figure 10:
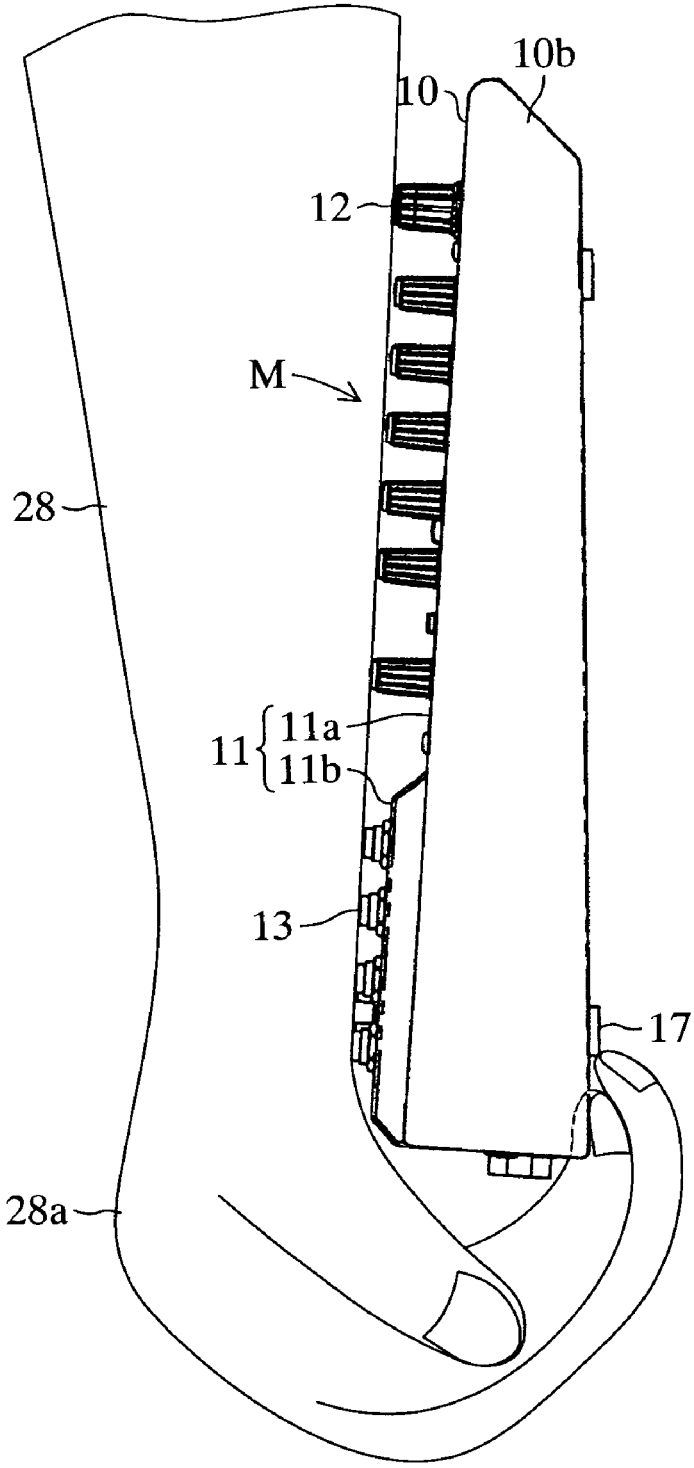
FIG. 10 is a side view showing a state in which the mixer is held by a hand.

When the mixer M is operated on the table 26, the user operates the mixer M from a low position, sitting on a chair. When placed on the table, the top surface 11 of the mixer M is slanted, with the front part positioned at a lower level than the rear part. This slanting surface provides the user with easy operability. When carrying the mixer M, as shown in FIG. 10, the user can easily carry the mixer M by holding the rear end of the mixer M with a hand 28*a*. Also, the user may carry the mixer M upside down, holding the front end of the mixer M with the user's hand 28*a*.

Furthermore, the user can dismantle the stand 20 by disengaging the stand pole 22 from the connecting part 21*b* of the tripod 21, which provides the stand 20 with transportability. Therefore, the user can bring the mixer M and stand 20 to a desired place and use them. When carrying, the user can easily engage and disengage the mixer M with/from the stand 20.

In the present embodiment, as described above, the mixer M is downsized, and the body 10 of the mixer M is formed by resin material, which provides the mixer M with reduced weight and easy transportability. Furthermore, the groove 15 provided on the under surface 14 of the body 10 further improves transportability of the mixer M, allowing the user to carry the mixer M easily by fitting his/her hand on the groove 15. Moreover, since the supporting member for supporting the mixer M is formed by the transportable stand 20, the stand 20 as well as the mixer M is adapted to be transportable. As a result, the user can carry the mixer M and stand 20 to any desired place and make use of them.

Furthermore, since the mixer M is mounted on the stand 20 by engaging the internal threads 16*a* of the mounting part 16 with the external threads 25*a* of the jointing part 25, the mounting and demounting of the mixer M is easy. In addition, the use of the clamp ring 24 and rotating member 23 further secures threaded engagement between the mounting part 16 and the jointing part 25.

At the mounting of the mixer M on the stand 20, the clamp ring 24 can be screwed easily because the mounting part 16 is projected out of the bottom base 15*a*. Since being located in the groove 15, in addition, the mounting part 16 can avoid breakage caused by contact with an object or the like, and the center of the gravity of the mixer M is placed at the low part thereof when mounted on the stand 20, providing improved stability.

Since the mounting part 16 is disposed at the position slightly moved off backward from the center of the bottom base 15*a* in the groove 15, furthermore, the stability of the mixer M mounted on the stand 20 with the cords 27 connected thereto is improved. Because the mounting part 16 is disposed at the position slightly moved off backward from the center of the bottom base 15*a*, in addition, a sufficient distance is kept between user's legs and the tripod 21 of the stand 20 in order to prevent the user's legs from touching and tripping over the tripod 21, securing user's safety. Moreover, the use of the stand 20 eliminates the need for a table, cutting down on costs.

The structure of the above-described embodiment may be optionally changed. For example, although the above-described embodiment employs the stand 20 comprising the tripod 21 and stand pole 22 which are threadedly interconnected, the stand 20 may be replaced by a stand with a foldable tripod such as a stand for mounting a camera. Further, any stand is applicable as far as it has threads at its upper end so that the mixer M can be mounted thereon.

In the above-described embodiment, furthermore, the mounting part 16 is made of metal, but the mounting part 16 may be made of resin material. In this case, a harder resin than the resin forming the body 10 is employed. In the above-described embodiment, moreover, the bottom base 15*a* of the groove 15 is formed in parallel with the top surface 11 of the body 10, but the bottom base 15*a* may not be in parallel with the top surface 11 of the body 10. In this case, the internal threads 16*a* are formed obliquely such that the top surface 11 of the body 10 stays substantially horizontal when the body 10 is mounted on the stand 20.

Although the mixer M is employed as an electro-acoustic apparatus in the above-described embodiment, the electro-acoustic apparatus according to the present invention is not limited to the mixer M but may be a recorder or the like. Particularly, electro-acoustic apparatuses having a body whose front part is lower than its rear part obtain a favorable effect.

What is claimed is:

1. An electronic audio apparatus being small enough to be transportable, wherein:

a multiplicity of operators are provided on a top surface of a body of the apparatus;

a groove is provided on an under surface of said body, the groove extends from one end of said under surface to the other end through the center of said under surface; and a multiplicity of internal threads are provided on the under surface of said body on said groove, and said internal threads extend in a direction internal to said body and are adapted to be engaged with external threads provided at the upper end of a stand, thereby allowing said electronic audio apparatus to be fixed on the upper end of the stand and supported by the stand, wherein said electronic audio apparatus is formed to have a low front part and a high rear part, and the groove has shallow depths at its front part and deep depths at its rear part, such that a top surface of said electronic audio apparatus has a low front part and a high rear part when placed on a table, and stays on a substantially horizontal position when mounted on said stand, and wherein said electronic audio apparatus is an audio mixer.

2. An electronic audio apparatus according to claim 1, wherein a level meter is provided on a front part of a top surface of said body.

3. An electronic audio apparatus according to claim 1, wherein triangular slanting surfaces respectively whose width is increased in their rear part are provided between the under surface of the body and side faces of the body.

4. An electronic audio apparatus according to claim 1, wherein discoid supportive protrusions, projecting out of the under surface, are provided at the vicinity of four corners of the under surface of the body.

5. An electronic audio apparatus according to claim 1, wherein a switch and a connector terminal are provided on a rear panel which is formed on the rear of the body.

* * * * *